United States Patent [19]

Nihei et al.

[11] Patent Number: 4,484,464

[45] Date of Patent: Nov. 27, 1984

[54] ELECTRICAL UPSETTING METHOD AND DEVICE THEREFOR

[75] Inventors: Tetsuo Nihei, Ooimachi; Toshio Maki, Kamifukuoka; Kazuyoshi Sakuma, Hidakamachi, all of Japan

[73] Assignee: Honda Giken Kogyo Kabushiki Kaisha, Toyko, Japan

[21] Appl. No.: 322,403

[22] Filed: Nov. 18, 1981

[30] Foreign Application Priority Data

Nov. 21, 1980 [JP] Japan ..... 55-164984
Nov. 21, 1980 [JP] Japan ..... 55-167892[U]

[51] Int. Cl.[3] ..... B21D 22/00; B21D 31/00; B21J 5/08

[52] U.S. Cl. ..... 72/38; 72/342; 72/354; 72/364

[58] Field of Search ..... 72/38, 342, 354, 358, 72/359, 364, 377; 219/151, 152

[56] References Cited

U.S. PATENT DOCUMENTS

| | | | |
|---|---|---|---|
| 3,120,769 | 2/1964 | Hatebur | 72/354 |
| 3,209,453 | 10/1965 | Bertoglio et al. | 72/358 X |
| 3,289,229 | 12/1966 | Friedman | 72/359 X |
| 3,487,196 | 12/1969 | Bachmann | 72/354 X |
| 3,808,865 | 5/1974 | Wagner et al. | 72/342 X |

*Primary Examiner*—E. Michael Combs
*Attorney, Agent, or Firm*—Polster, Polster and Lucchesi

[57] ABSTRACT

An electrical upsetting method for upsetting a cylindrical metal material, which is durable against wear and tear due to high temperature as well as vigorous friction under heavy pressure during the upsetting work, wherein a space gap is provided between the outer peripheral surface of the workpiece and the inner peripheral surface of the shaping die to prevent the die from direct heat from the workpiece generated by electric conduction across the electrodes, or wherein a space gap is provided between the outer peripheral surface of the anvil electrode and the inner peripheral surface of the shaping die, and an inert gas is filled in the space gap to protect the die from oxidation due to its exposure to the external atmosphere, or air, as well as to maintain the die in a cooled condition by the inert gas.

The present invention also proposes an improved electrical upsetting device provided with the inert gas feeding device which supplies such inert gas through the communicating grooves into the space gap defined between the anvil electrode and the shaping die to prevent the die from wear and tear due to its oxidation through exposure to the external atmosphere, thereby securing long service life of the shaping die.

3 Claims, 16 Drawing Figures

1
2
3
4
4I
5
6
S
W
W'

ELECTRICAL UPSETTING METHOD AND DEVICE THEREFOR

BACKGROUND OF THE INVENTION

1. Field of the Invention

This invention relates to a method and device for electrical upsetting, that is, expanding to increase the diameter of the end part of metal raw material such as rods, pipes, and the like, in the main, by resistive heat generation at that part to soften.

2. Description of Prior Arts

The electrical upsetting method which has so far been in practice comprises the following four steps, in reference to FIGS. 1A through D of the accompanying drawing, wherein a reference numeral 1 designates a cylindrical shaping die for the upsetting work, a numeral 2 refers to a reinforcing ring for the shaping die 1, a numeral 3 denotes a die holder, 4 designates an anvil electrode having an electrode tip 41 at its distal end and also serving as a knock-out rod, 5 indicates a bushing to guide the forwarding and retracting movements of the anvil electrode 4, and 6 refers to an electrode in a clamping type, for example, to contact with a workpiece W.

Step A: The anvil electrode 4 is forwarded to position its distal end part 41 at the entrance opening of the shaping die 1, and the end face of the workpiece W clamped by the clamp electrode 6 is butted to the abovementioned electrode tip 41.

Step B: Electric current is caused to flow across the anvil electrode 4 and the clamp electrode 6, and, as the anvil electrode 4 is being gradually retracted, the workpiece W is pushed into the shaping die 1 under a strong pressure, during which the end part W' of the workpiece becomes softened by heat generated to contact the inner peripheral surface of the shaping die 1.

Step C: The workpiece W is further pushed into the die 1 until the electrode tip 41 reaches the bottom (or the innermost) part of the shaping die 1, when the upsetting work is terminated.

Step D: The clamp electrode 6 is released from the workpiece W, and the anvil electrode 4 is forwarded to thereby knock out the thus upset workpiece W from the shaping die 1.

In more detail, the end part W' of the workpiece increases its diameter and upset during the abovementioned steps B and C to contact the inner peripheral surface of the shaping die 1, and slide-moves along the contacted surface. In this case, the inner peripheral surface of the shaping die 1 for shaping the end part W' of the workpiece W, which has been softened by heat generation into an intended or predetermined shape is brought to a high temperature condition along with heating of the workpiece W, and is also subjected to vigorous frictional force with the result that it tends to be readily worn out. As the consequence of this, the service life of the shaping die 1 is generally short, and frequent exchange of the part is unavoidable. On account of this, a number of spare shaping dies have to be provided beforehand in preparation for such exchange.

Moreover, since the inner peripheral surface of the shaping die is more or less exposed to the external atmosphere, or air, it tends to be readily oxidized, which accelerates wear and tear in a rather short period of service.

SUMMARY OF THE INVENTION

It is therefore an object of the present invention to provide an improved method for the electrical upsetting work of the tubular or rod-shaped metal material, which is free from the above-described disadvantages inherent in the known upsetting methods.

It is another object of the present invention to provide an improved electrical upsetting device having good durability against oxidation due to exposure of the shaping die to the external atmosphere, and also against vigorous frictional force caused to the inner peripheral surface thereof during the upsetting work.

According to the present invention, in one aspect thereof, there is provided an electrical upsetting method of a cylindrical metal material which comprises steps of: causing an anvil electrode and an end face of a workpiece to contact each other in a shaping die; conducting electric current across electrodes to generate heat at the end part of said workpiece to soften the end portion; pushing said workpiece to the anvil electrode under vigorous pressure, while withdrawing the anvil electrode toward the bottom or the innermost part of said shaping die, to upset the end part following said shaping die; and discharging said workpiece out of said shaping die by forwarding said anvil electrode.

According to the present invention, in another aspect thereof, there is provided an electrical upsetting device for upsetting cylindrical metal material, which comprises in combination: an anvil electrode, to which an end face of a workpiece is butted; another electrode to be connected with said workpiece; a shaping die provided between said anvil electrode and said another electrode with the anvil electrode constituting the bottom or the innermost part of the shaping die; and an inert gas feeding source, a space gap being formed between the outer peripheral surface of said anvil electrode which moves back and forth in an along said shaping die and the inner peripheral surface of said shaping die to be communicatively connected with said inert gas feeding source through passage grooves.

There has thus been outlined, rather broadly, the more important feature of the present invention in order that the detailed description thereof that follows may be better understood, and in order that the present contribution to the art may be better appreciated. There are, of course, additional features of the invention that will be described hereinafter and which will form the subject of the claim appended hereto. Those skilled in the art will appreciate that the conception, upon which this disclosure is based may readily be utilized as a basis for the designing of other structure for carrying out the several purposes of the present invention. It is important, therefore, that the claims be regarded as including such equivalent construction so far as they do not depart from the spirit and scope of the present invention.

BRIEF DESCRIPTION OF THE ACCOMPANYING DRAWING

Specific embodiments of the present invention have been chosen for the purpose of illustration and description, and are shown in the accompanying drawing, forming a part of the specification, in which.

DETAILED DESCRIPTION OF PREFERRED EMBODIMENTS

Figure 1A:
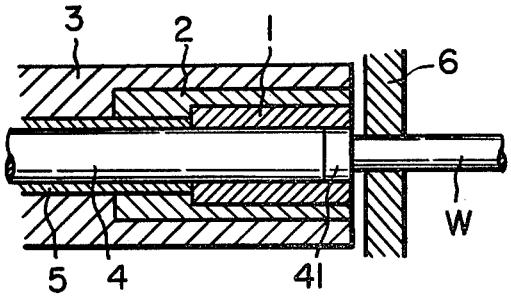
FIG. 1A PRIOR ART
FIGS. 1A through 1D are respectively schematic side views, in longitudinal cross-section, showing the sequential steps in the conventional electrical upsetting method.
Figure 1B:
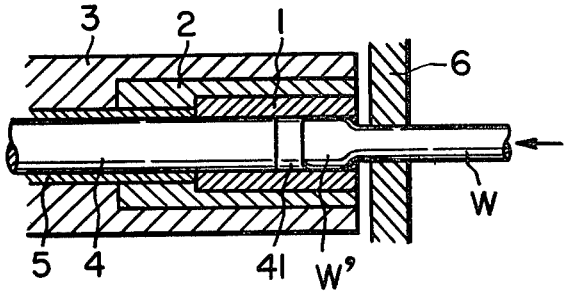
FIG. 1B PRIOR ART
Figure 1C:
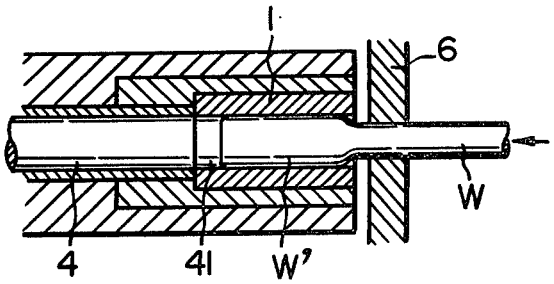
FIG. 1C PRIOR ART
Figure 1D:
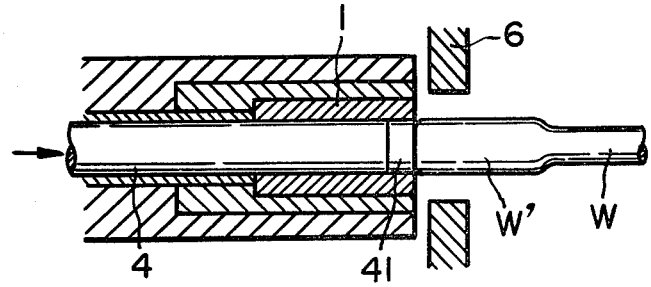
FIG. 1D PRIOR ART
Figures 2A, 2B, 2C, 2D, 2E, 2F:
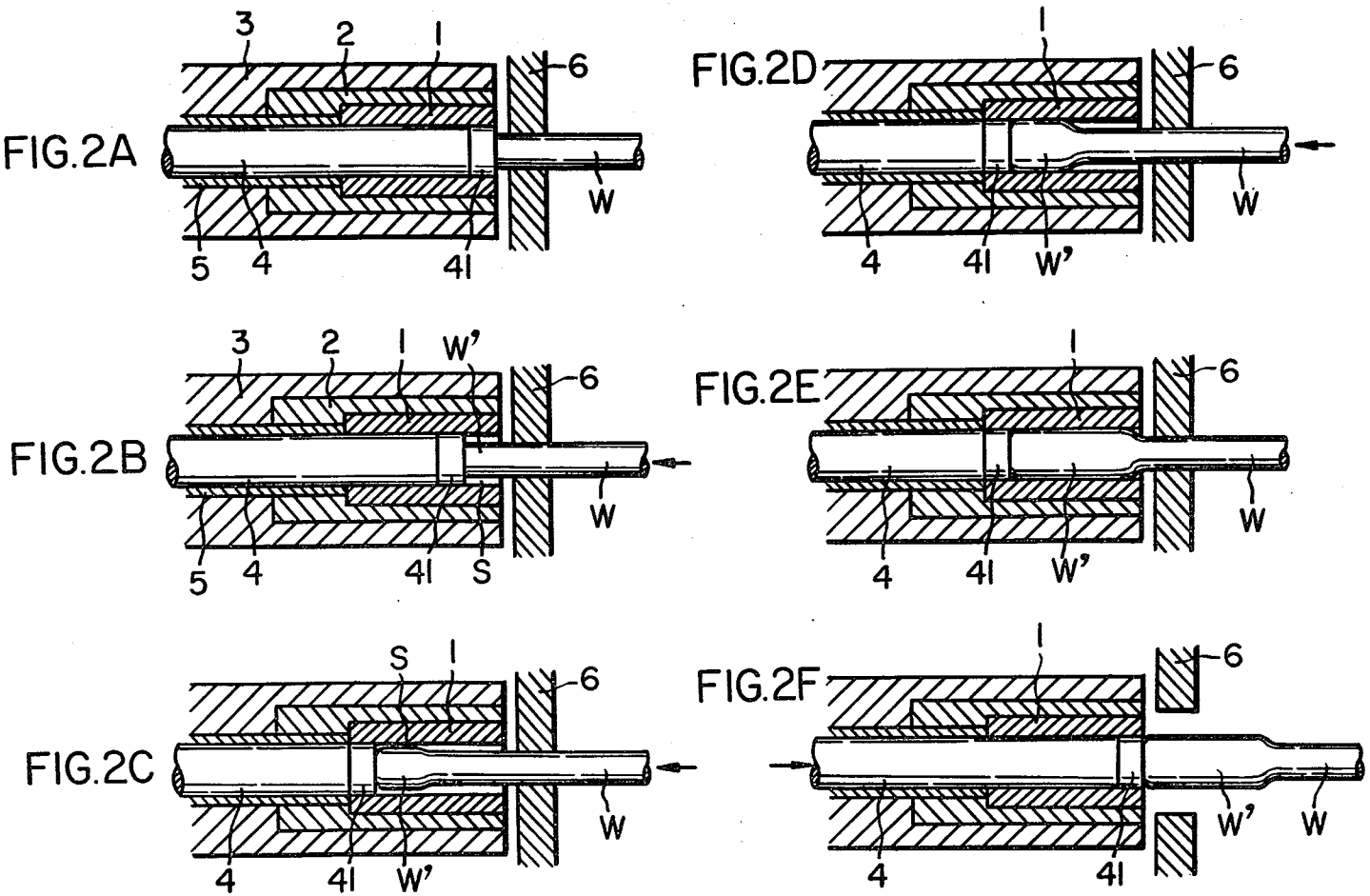
FIGS. 2A through 2F are respectively schematic side views, in longitudinal cross-section, showing the sequential steps in the electrical upsetting method according to the present invention.
Figure 3A:
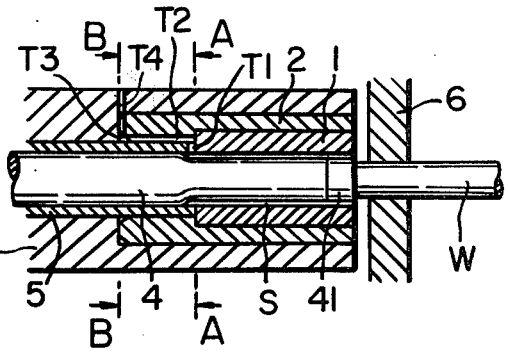
FIGS. 3A through 3D are respectively schematic side views, in longitudinal cross-section, showing the improved construction of the electrical upsetting device according to the present invention as well as the sequential steps of the electrical upsetting work using the same.
Figure 4:
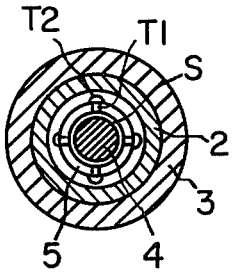
FIG. 4 is a cross-sectional view of the electrical upsetting device according to the present invention taken along a line A—A in FIG. 3A.
Figure 3B:
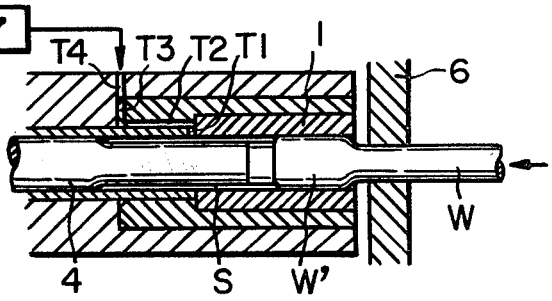
Figure 5:
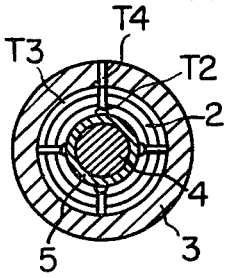
FIG. 5 is also a cross-sectional view of the electrical upsetting device according to the present invention, taken along a line B—B in FIG. 3A.
Figure 3C:
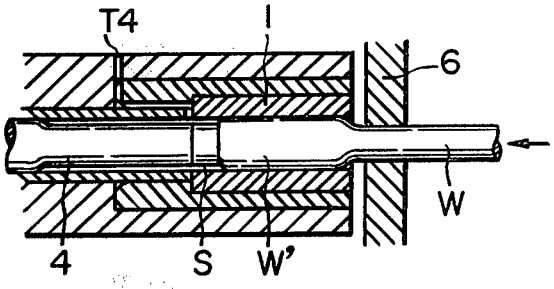
Figure 3D:
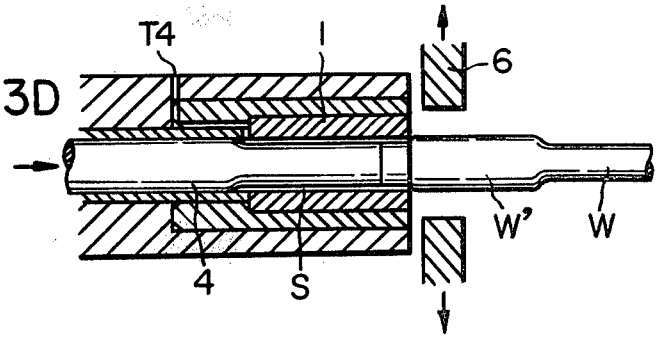

In the following, the preferred embodiments of the electrical upsetting method and device according to the present invention will be described in speicific details in reference to FIGS. 2A through 2F as well as FIGS. 3, 4 and 5 of the accompanying drawing.

The electrical upsetting method according to the present invention, in contrast to the afore-described conventional upsetting method, comprises the following steps.

Step A: The anvil electrode 4 is forwarded to position its distal end part 41 at the entrance opening of the shaping die 1, and the end face of the workpiece W clamped by the clamp electrode 6 is butted to the abovementioned electrode tip 41.

Step B: In a state of the workpiece W being butted to the electrode tip 41, the anvil electrode 4 is retreated for a certain definite distance, after which electric current is caused to flow across the anvil electrode 4 and the clamp electrode 6. A clearance S is present between the workpiece W and the inner peripheral surface of the shaping die 1. After lapse of a certain time period, the end part W' of the workpiece generates heat to become softened.

Step C: Subsequently, in the state of the head-to-head contact of the workpiece and the anvil electrode and the current conduction across the anvil electrode and the clamp electrode as mentioned above, the anvil electrode 4 is withdrawn until the electrode tip 41 reached the bottom (or the innermost) part of the shaping die 1, while the workpiece W is being pushed into the shaping die under a vigorous pressure force, whereby the end part W' of the workpiece W becomes gradually swollen and the upsetting work starts.

Step D: The workpiece W is continued to be pushed under a vigorous pressure force into the shaping die 1, whereby the end part W' of the workpiece W contacts the inner peripheral surface of the shaping die 1.

Step E: The end part W' of the workpiece W fully expands within the interior of the shaping die 1 and shaped into predetermined size and shape.

Step F: The clamp electrode 6 is released or relaxed from the workpiece W, and then the anvil electrode 4 is forwarded to knock out the thus upset workpiece W from the shaping die 1.

Since the electrical upsetting method according to the present invention is performed in the above-described sequential process steps, the clearance S present between the outer peripheral surface of the end part W' of the workpiece W and the inner peripheral surface of the shaping die 1 prevents or delays direct heating of the shaping die 1 during the steps B and C, due to heat generation in the workpiece W, and this space gap S diminishes to extinction during the step D by swelling or upsetting of the distal end of the workpiece W through its diametrical increase due to pushing under vigorous pressure into the shaping die.

Accordingly, while the upsetting work is being performed, there takes place no slide-movement between the outer peripheral surface of the end part W' of the workpiece and the inner peripheral surface of the shaping die 1, which results in the least wear in the shaping die 1 and produces a remarkable effect of improving the durability of the shaping die.

In addition, since the distal end of the workpiece W first generates heat due to the electric current conduction to increase the electrical resistance at that part from the heat as generated and the current flows rearward from the distal end of the workpiece W, the heat generation and softening of the workpiece at the distal end W' thereof is favorable, whereby the end part W' can be easily upset.

In the following, the electrical upsetting device according to the present invention will be described in reference to the accompanying drawing. As illustrated in FIGS. 3 to 5, the electrical upsetting device of the present invention is basically constructed with the cylindrical upsetting die 1, the reinforcing die 2 for the shaping die 1, the die holder 3, the anvil electrode 4 having the electrode tip 41 at its distal end and also serving as the knock-out rod, the bushing 5 to guide the forwarding and retracting motions of the anvil electrode 4, and the clamping type electrode 6 to be connected with the workpiece W. A space gap S is formed between the inner peripheral surface of the shaping die 1 and the outer peripheral surface of the anvil electrode 4 by reducing, to a slight extent, the diameter of the anvil electrode 4 at its portion to be inserted into, and extended through, the shaping die 1.

The abovementioned space gap S is communicatively connected to an inert gas feeding source 7 such as, for example, nitrogen gas feeding source, through a radial groove T1 formed at the end face of the bushing 5, an axial groove T2 defined in the inner peripheral surface of the reinforcing ring 2, and annular groove T3 formed at a portion where the inner end face of the reinforcing die 2 and the die holder 3 meet, and a groove T4 radially extending through the die holder 3 and reaching the abovementioned annular groove T3. It is to be noted that the inert gas is continuously fed under a constant pressure.

In the following, the upsetting steps using the above-described upsetting device according to the present invention will be described in reference to FIGS. 3A to 3D.

Step A: The anvil electrode 4 is forwarded to position its distal end part 41 at the entrance opening of the shaping die 1, and the end face of the workpiece W clamped by the clamp electrode 6 is butted to the abovementioned electrode tip 41. The inert gas flows into the space gap S between the outer peripheral surface of the anvil electrode 4 and the inner peripheral surface of the shaping die 1 through the grooves T1, T2, T3 and T4, respectively.

Step B: Electric current is caused to flow across the anvil electrode 4 and the clamp electrode 6, and, as the anvil electrode 4 is being gradually retreated, the workpiece W is pushed into the shaping die 1 under a vigorous pressure, during which the end part W'of the workpiece becomes softened by heat generated to contact the inner peripheral surface of the shaping die 1.

Step C: The workpiece W is further pushed into the die 1 until the electrode tip 41 reaches the bottom (or the innermost) part of the shaping die 1, when the upsetting work is terminated.

Step D: The clamp electrode 6 is released from the workpiece W, and the anvil electrode 4 is forwarded to thereby knock out the thus upset workpiece W from the shaping die 1.

In the above-described steps B and C, since the space gap between the inner peripheral surface of the shaping die 1 and the outer periphery of the anvil electrode 4 is filled with the inert gas immediately before the end part W' of the workpiece 1 contact thereto by expansion, there occurs no oxidation of the shaping die 1. In addition, the shaping die 1 is sufficiently cooled by the inert gas to be well protected from overheating.

Furthermore, at the time of knocking out the workpiece from the die at the step D, and even thereafter, the inert gas continues to flow through the space gap S, so that no air possibly intrudes into the gap. In other words, since the inner peripheral surface of the shaping die 1 does not contact air during the upsetting work, the shaping die 1 can be well prevented from wear and tear to the substantially perfect extent to be ascribable to oxidation, as well as from deterioration due to the high temperature generated during the upsetting work. Consequently, in conjunction with the cooling effect of the inert gas, the durability of the shaping die 1 improves remarkably and effectively.

What is claimed is:

1. A method for electrical upsetting of a workpiece of cylindrical metal material having an end face, which comprises steps of:

(a) causing an anvil electrode with a forward face and said end face of said workpiece to contact each other in a hollow, open-ended shaping die with an inner surface, an entrance opening and a bottom part a bottom wall of which is defined by said anvil electrode forward face;

(b) conducting electric current across electrodes to generate heat at the end part of said workpiece adjacent said anvil electrode forward face to soften the end portion of said workpiece;

(c) withdrawing and stopping said anvil electrode toward the bottom part of said shaping die, keeping in contact said anvil electrode and the end face of the workpiece while maintaining a space between the said workpiece and the inner surface of said shaping die, subsequently, pushing said workpiece to the anvil electrode under vigorous pressure, to upset said end part within said shaping die; and (d) discharging said workpiece out of said shaping die by moving said anvil electrode forward.

2. A method for electrical upsetting of a workpiece of cylindrical metal material having an end face, which comprises steps of:

(a) causing an anvil electrode with a forward face and said end face of said workpiece to contact each other in a hollow, open-ended shaping die with an inner peripheral surface, an entrance opening and a bottom part a bottom wall of which is defined by said anvil electrode forward face, while causing an inert gas to flow from the bottom part of said shaping die to the entrance opening of said shaping die, through a gap defined between an outer peripheral surface of said anvil electrode and the inner peripheral surface of said shaping die;

(b) conducting electric current across electrodes to generate heat at the end part of said workpiece adjacent said anvil electrode forward face to soften the end portion of said workpiece;

(c) withdrawing and stopping said anvil electrode toward the bottom part of said shaping die, keeping in contact said anvil electrode and the end face of the workpiece while maintaining a space between the said anvil electrode and the inner surface of said shaping die, simultaneously pushing said workpiece to the anvil electrode under vigorous pressure, to upset the end part following said anvil electrode; and (d) discharging said workpiece out of said shaping die by moving said anvil electrode forward.

3. An electrical upsetting device for upsetting an end of a workpiece of metal cylindrical material, which comprises in combination:

(a) an anvil electrode, having a peripheral surface and a forward end face to which said end face of said workpiece is abutted;

(b) another electrode to be connected with said workpiece;

(c) an elongated, hollow shaping die having an inner peripheral surface, an entrance opening and a bottom part, within which die said anvil electrode is axially moveably mounted, provided between said anvil electrode and said another electrode, with the forward end face of the anvil electrode constituting the bottom wall of the shaping die; and (d) an inert gas feeding source, a gap being formed between the outer peripheral surface of said anvil electrode which moves back and forth in and along said shaping die and the inner peripheral surface of said shaping die to be communicatively connected with said inert gas feeding source, through passage grooves from the bottom part of said shaping die, to the entrance opening of said shaping die.

* * * * *